US010768546B2

(12) United States Patent
Maejima et al.

(10) Patent No.: US 10,768,546 B2
(45) Date of Patent: Sep. 8, 2020

(54) CARTRIDGE AND IMAGE FORMING APPARATUS

(71) Applicant: CANON KABUSHIKI KAISHA, Tokyo (JP)

(72) Inventors: Masato Maejima, Toride (JP); Michihiro Yoshida, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/393,224

(22) Filed: Apr. 24, 2019

(65) Prior Publication Data

US 2019/0346787 A1 Nov. 14, 2019

(30) Foreign Application Priority Data

May 10, 2018 (JP) ..... 2018-091551

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
USPC ..... 399/107, 111, 115, 168, 174, 176
See application file for complete search history.

(56) References Cited

U.S. PATENT DOCUMENTS 6,898,401 B2 5/2005 Okano et al.
7,933,533 B2 * 4/2011 Higaki ..... G03G 15/0225 399/100
8,000,633 B2 8/2011 Kato et al.
8,346,132 B2 * 1/2013 Sato ..... G03G 15/0233 399/168
8,805,244 B2 * 8/2014 Hoshio ..... G03G 15/0233 399/176
10,268,132 B2 4/2019 Fujino et al.

FOREIGN PATENT DOCUMENTS

JP 7-20692 A 1/1995
JP 2009-122316 A 6/2009
JP 2010-048883 A 3/2010
JP 2011-13462 A 1/2011

OTHER PUBLICATIONS

Mori, U.S. Appl. No. 16/393,212, filed Apr. 24, 2019.
Fujino et al., U.S. Appl. No. 16/393,240, filed Apr. 24, 2019.

* cited by examiner

*Primary Examiner* — Hoan H Tran
(74) *Attorney, Agent, or Firm* — Venable LLP

(57) ABSTRACT

An image forming apparatus includes a photosensitive member and a charging roller to which a direct current voltage is applied. A difference between a first potential (before charging) and a second potential (after charging) of a surface of the photosensitive member in an image forming operation is smaller than 100 V. The charging roller includes a shaft portion, an elastic layer provided on an outer periphery of the shaft portion, and a surface layer provided on an outer periphery of the elastic layer. A ten point height of roughness profile Rz (μm) and a root mean square slope RΔq with respected to a surface of the charging roller satisfy Rz≥7 and RΔq≤0.1.

9 Claims, 7 Drawing Sheets

CARTRIDGE AND IMAGE FORMING APPARATUS

BACKGROUND OF THE INVENTION

Field of the Invention

The present invention relates to a cartridge and an image forming apparatus including a charging roller configured to charge an image bearing member in an electrophotographic process.

Description of the Related Art

For a charging unit configured to charge an image bearing member in an image forming apparatus of an electrophotographic system, a contact charging system in which a voltage is applied to a charging roller brought into contact with the image bearing member is widely used. There is a case where a so-called filming phenomenon occurs in which soiling matter such as toner attached to the image bearing member, an external additive added to the toner, and an electrical discharge product generated at the time of charging is attached to and accumulated on such a charging roller. When a filming phenomenon occurs, sometimes an image defect occurs in a position corresponding to a part of the charging roller to which the soiling matter is attached in an image formed on a recording material. For example, in the case where a halftone image is output, sometimes a portion of a high image density is generated in a streak shape in a conveyance direction of the recording material, that is, in a rotation direction of the charging roller. The portion of a high image density will be hereinafter referred to as a contamination streak.

Conventionally, a technique of suppressing the filming phenomenon by imparting an appropriate surface roughness to the surface of the charging roller is proposed. Japanese Patent Laid-Open No. 2010-048883 discloses that setting the ten point height of roughness profile Rz of the charging roller within a range of 7 μm to 30 μm is effective for suppressing attachment of soiling matter.

However, as a result of intensive studies by the inventors, it was found that in the case where a surface roughness of a certain degree or more is imparted to the charging roller, the amount of electrical discharge becomes uneven due to recesses and projections on the surface of the charging roller, and as a result small unevenness of density occurs in the output image. This unevenness of density degrades the uniformity of a halftone region, and gives a rough texture to the output image. In particular, in the case where a direct current charging system: DC charging system is employed to simplify the apparatus, the problem of the unevenness of density is more critical. Improving the charging uniformity by performing pre-exposure of the photosensitive member to suppress the unevenness of density after transfer and before charging can be also considered, but this leads to increase in the cost.

SUMMARY OF THE INVENTION

The present invention provides a cartridge and an image forming apparatus including a charging roller capable of improving the image quality while suppressing attachment of soiling matter.

According to one aspect of the invention, an image forming apparatus includes: a photosensitive member; and a charging roller to which a direct current voltage is applied and which is configured to charge a surface of the photosensitive member at a charging position, wherein the charging roller includes a shaft portion, an elastic layer provided on an outer periphery of the shaft portion, and a surface layer provided on an outer periphery of the elastic layer, and wherein a ten point height of roughness profile Rz (μm) and a root mean square slope RΔq with respected to a surface of the charging roller satisfy $Rz \geq 7$ and $R\Delta q \leq 0.1$.

According to another aspect of the invention a cartridge includes: a photosensitive member; and a charging roller to which a direct current voltage is applied and which is configured to charge a surface of the photosensitive member at a charging position, wherein the charging roller includes a shaft portion, an elastic layer provided on an outer periphery of the shaft portion, and a surface layer provided on an outer periphery of the elastic layer, and wherein a ten point height of roughness profile Rz (μm) and a root mean square slope RΔq with respected to a surface of the charging roller satisfy $Rz \geq 7$ and $R\Delta q \leq 0.1$.

Further features of the present invention will become apparent from the following description of exemplary embodiments with reference to the attached drawings.

DESCRIPTION OF THE EMBODIMENTS

Exemplary embodiments of the present invention will be described with reference to drawings.

First Exemplary Embodiment

Image Forming Apparatus

Figure 1:
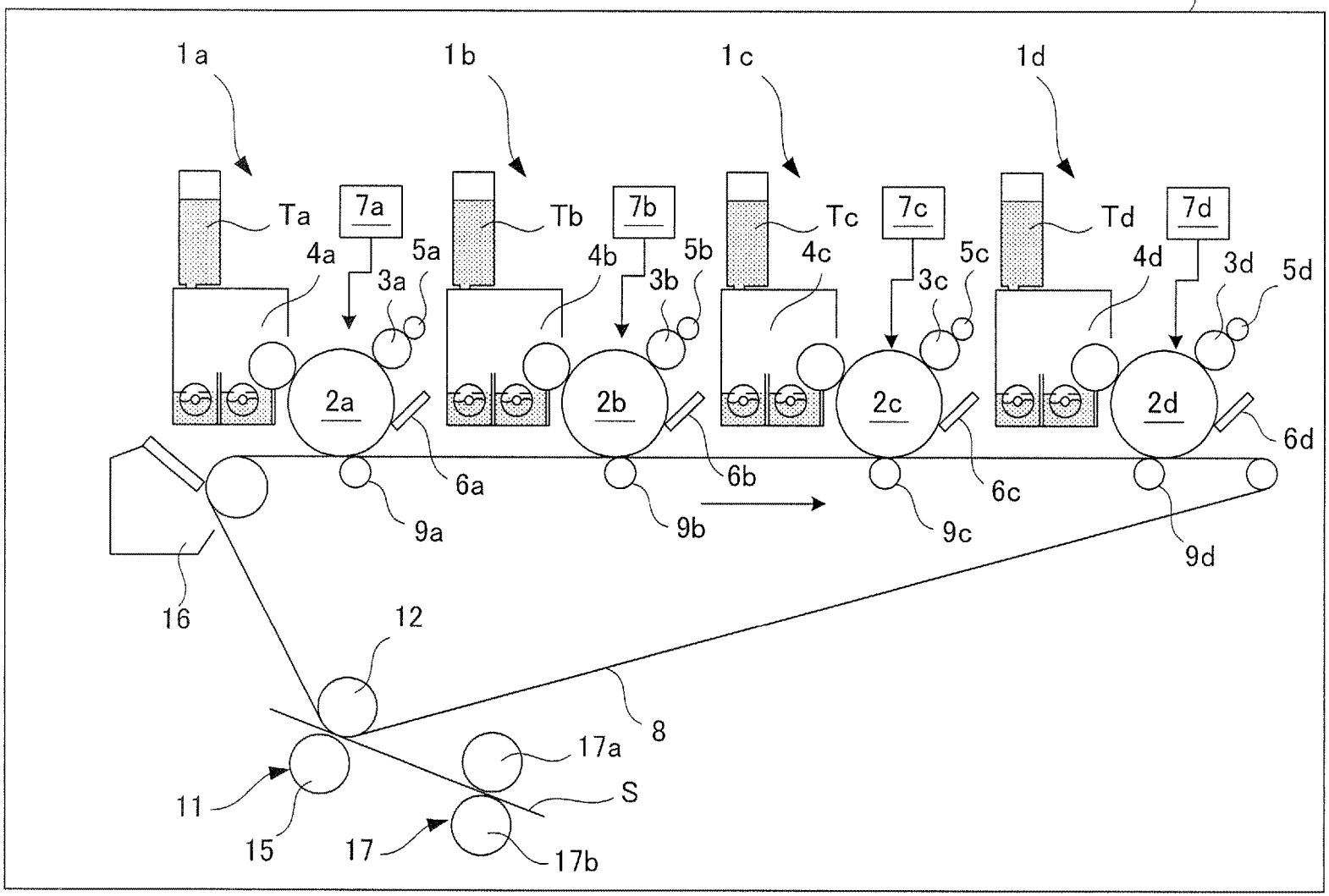
FIG. 1 is a schematic diagram illustrating an image forming apparatus according to the present disclosure.

FIG. 1 is a configuration diagram of an image forming apparatus 100 of a 4-drum in-line system. The image forming apparatus 100 includes four image forming units 1*a*, 1*b*, 1*c*, and 1*d* that respectively form images of yellow, magenta, cyan, and black. The four image forming units 1*a*, 1*b*, 1*c*, and 1*d* are arranged in a line with equal intervals therebetween.

The image forming units 1*a* to 1*d* respectively include photosensitive drums 2*a*, 2*b*, 2*c*, and 2*d* serving as image bearing members. The photosensitive drums 2*a* to 2*d* each have a photosensitive layer of an organic photoconductor: OPC having a negative charging polarity on a base drum body of aluminum or the like, and are each rotationally driven by a driving unit at a predetermined process speed.

Charging rollers 3*a*, 3*b*, 3*c*, and 3*d*, charging cleaning members 5*a*, 5*b*, 5*c*, and 5*d*, developing units 4*a*, 4*b*, 4*c*, and 4*d*, and drum cleaning units 6*a*, 6*b*, 6*c*, and 6*d* are respectively disposed around the photosensitive drums 2*a* to 2*d*. Further, exposing units 7*a*, 7*b*, 7*c*, and 7*d* are respectively disposed above the photosensitive drums 2*a* to 2*d*. The developing units 4*a* to 4*d* respectively accommodate developers containing yellow, cyan, magenta, and black toners. In addition, the developing units 4*a* to 4*d* are respectively configured such that toner is supplied from corresponding toner bottles Ta, Th, Tc, and Td.

The image forming units 1*a* to 1*d* are each preferably configured as a cartridge detachably attached to an apparatus body of the image forming apparatus 100. The cartridges according to the present exemplary embodiment at least respectively include the photosensitive drums 2*a* to 2*d* and the charging rollers 3*a* to 3*d*. These cartridges may be also configured as process cartridges further respectively including the developing units 4*a* to 4*d* and the drum cleaning units 6*a* to 6*d*.

An intermediate transfer belt 8 that is a rotatable endless belt is disposed to face the photosensitive drums 2*a* to 2*d* of the respective image forming units. The intermediate transfer belt 8 serving as an intermediate transfer body is stretched over a plurality of rollers including a secondary-transfer opposing roller 12. The intermediate transfer belt 8 is driven by a roller connected to a motor, and is thus rotated in an arrow direction, that is, in a clockwise direction in FIG. 1. Primary transfer rollers 9*a*, 9*b*, 9*c*, and 9*d* are disposed on the inner peripheral side of the intermediate transfer belt 8 at positions respectively opposing the photosensitive drums 2*a* to 2*d*. The secondary-transfer opposing roller 12 abuts a secondary transfer roller 15 with the intermediate transfer belt 8 therebetween, and thus forms a secondary transfer portion 11.

A belt cleaning unit 16 that removes and collects transfer residual toner remaining on the surface of the intermediate transfer belt 8 is disposed on the outer peripheral side of the intermediate transfer belt 8. In addition, a fixing unit 17 including a fixing roller 17*a* and a pressurizing roller 17*b* for performing a heat pressure process to fix toner onto a recording material S is disposed downstream of the secondary transfer portion 11 in a rotation direction of the intermediate transfer belt 8.

When a start signal to start an image forming operation is transmitted from a controller of the image forming apparatus 100, recording materials S are delivered out from a cassette and conveyed to a registration roller one by one. The recording material S stands by in a state of abutting the registration roller in a stationary state.

A process of forming a toner image in each of the image forming units 1*a* to 1*d* will be described with reference to FIG. 2. To be noted, although the description will be given by taking the yellow image forming unit 1*a* as an example, the steps of the process are the same for the other image forming units. When the start signal is transmitted from the controller, the photosensitive drum 2*a* starts rotating at a predetermined process speed. The photosensitive drum 2*a* is uniformly charged to a negative polarity by the charging roller 3*a*. The exposing unit 7*a* performs scanning exposure by irradiating the photosensitive drum 2*a* with laser light, and thus forms an electrostatic latent image on the surface of the photosensitive drum 2*a*. This electrostatic latent image is developed as a toner image with toner supplied from the developing unit 4*a*. The charging cleaning member 5*a* removes soiling matter attached to the surface of the charging roller 3*a* as a result of being transferred from the photosensitive drum 2*a* to the charging roller 3*a* or the like, and thus maintains the performance of the charging roller 3*a*. Examples of the soiling matter include toner, external additives, debris of the photosensitive drums, and paper dust.

Regarding the order of image forming operation, first, formation of a yellow toner image is started in the image forming unit 1*a*, and then the yellow toner image is transferred onto the rotating intermediate transfer belt 8 through primary transfer by the primary transfer roller 9*a*. A region to which the yellow toner image on the intermediate transfer belt 8 has been transferred is moved toward the magenta image forming unit 1*b* by the rotation of the intermediate transfer belt 8. Then, also in the image forming unit 1*b*, the magenta toner image formed on the photosensitive drum 2*b* in a similar manner is transferred so as to be superimposed on the yellow toner image on the intermediate transfer belt 8 by the primary transfer roller 9*b*. Subsequently, cyan and black toner images respectively formed in the image forming units 1*c* and 1*d* are sequentially transferred by the primary transfer rollers 9*c* and 9*d* so as to be superimposed on the yellow and magenta toner images that have been already transferred, and thus a full-color toner image is formed on the intermediate transfer belt 8.

Further, the registration roller conveys the recording material S to the secondary transfer portion 11 at a timing matching a timing when the leading end of the full-color toner image born on the intermediate transfer belt 8 reaches the secondary transfer portion 11. A bias voltage of an opposite polarity to the toner serving as a secondary transfer voltage is applied to the secondary transfer roller 15. As a result of this, in the secondary transfer portion 11, the full-color toner image is collectively transferred from the intermediate transfer belt 8 onto the recording material S through secondary transfer. The recording material S onto which the toner image has been transferred is conveyed to the fixing unit 17, and heated and pressurized in a fixing nip portion formed by the fixing roller 17*a* and the pressurizing roller 17*b*. The toners of respective colors melt and then adheres to the recording material S, and thus the image is fixed to the recording material S. Then, the recording material S is discharged to a discharge tray provided in the image forming apparatus 100 or to a sheet processing apparatus that performs post-processing such as a binding process on the recording material S.

The image forming apparatus 100 described above is an example of an image forming apparatus, and for example, the image forming apparatus 100 may be a system in which a toner image formed on a photosensitive drum is directly transferred onto the recording material S without an intermediate transfer body. In addition, examples of the image forming apparatus include printers, copiers, facsimile machines, and multifunctional apparatuses having functions of these.

Configuration Example of Image Forming Unit

The photosensitive drums 2*a* to 2*d* serve as image bearing members in the present exemplary embodiment. The charging rollers 3*a* to 3*d* serve as charging rollers for charging the surfaces of the image bearing members in the present exemplary embodiment, and the details thereof will be described later. The exposing units 7*a* to 7*d* serve as exposing units for drawing electrostatic latent images on the image bearing members in the present exemplary embodiment. The developing units 4*a* to 4*d* serve as developing units for developing the electrostatic latent images born on the image bearing members in the present exemplary embodiment. The transfer unit including the intermediate transfer belt 8 and the secondary transfer roller 15 serves as a transfer unit for transferring the toner images born on the image bearing members onto a recording material in the present exemplary embodiment. Specifically, for these constituent elements, ones configured as follows can be used.

Figure 2:
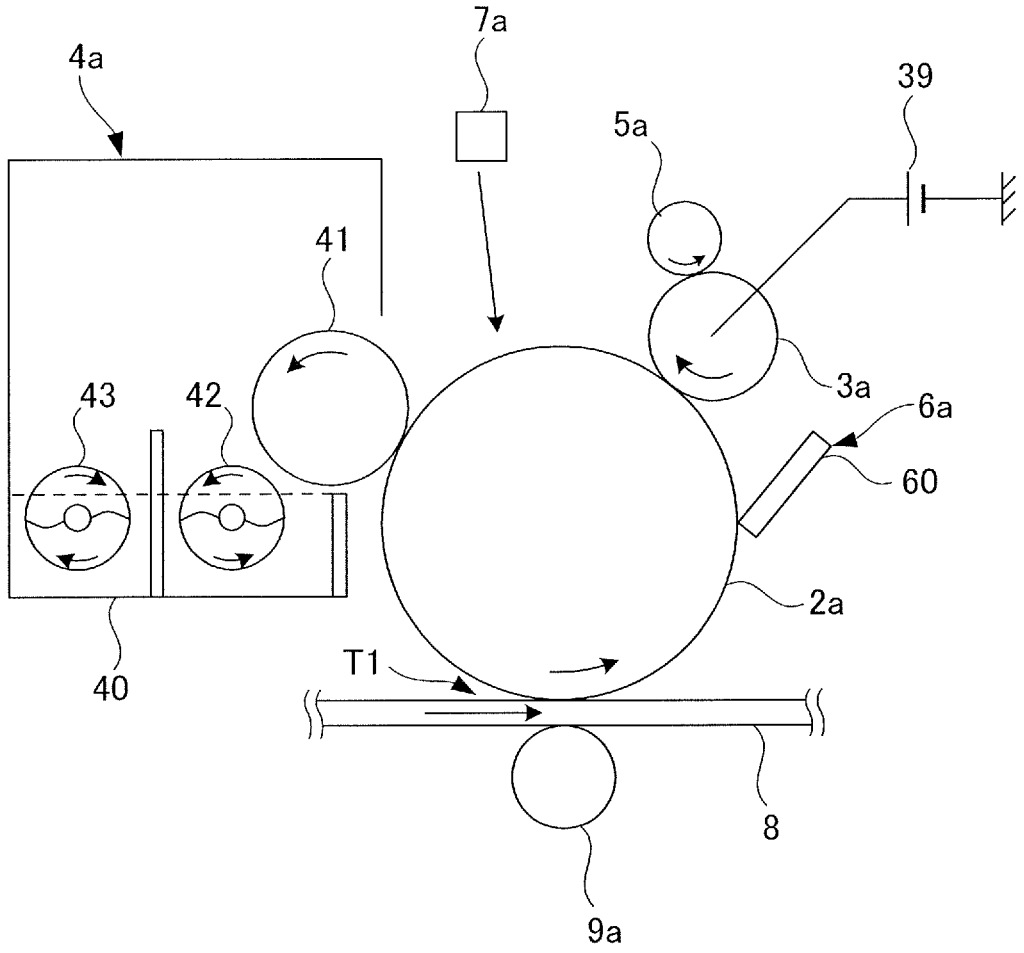
FIG. 2 is a schematic diagram illustrating a configuration of an image forming unit.

The photosensitive drum 2*a* illustrated in FIG. 2 is formed by laminating an organic photoconductor layer: OPC layer on an aluminum drum, and the outer diameter thereof is 30 mm. The charging polarity of the photoconductor layer is a negative polarity, and the photosensitive drum 2*a* is configured to rotate at a process speed of 120 mm/sec in terms of a peripheral speed about a center shaft. To be noted, although the photoconductor layer is not particularly limited, for example, an amorphous silicon layer: a-Si layer having excellent durability may be used.

The charging roller 3*a* is disposed to oppose the photosensitive drum 2*a*, and rotates in accordance with the rotation of the photosensitive drum 2*a*. A direct current voltage of, for example, −1200 V is applied from a charging power source 39 serving as a voltage application unit to the charging roller 3*a*, and thus the charging roller 3*a* charges the surface of the photosensitive drum 2*a* to a predetermined surface potential serving as a primary charging potential. In addition, as the charging cleaning member 5*a*, a foam sponge roller having an outer diameter of 6 mm is used. This sponge roller is pressed against the charging roller 3*a* by a predetermined pressurizing force, and removes soiling matter attached to the surface of the charging roller 3*a* while rotating in accordance with the charging roller 3*a*.

The exposing unit 7*a* scans and radiates a laser beam subjected to ON-OFF modulation based on scanning line image data, that is, a so-called video signal, in which an image to be printed is decomposed into decomposed color images of respective color components, onto the photosensitive drum 2*a*. As a result of this, the exposing unit 7*a* draws an electrostatic latent image corresponding to a decomposed color image on the surface of the photosensitive drum 2*a*.

The developing unit 4*a* agitates a two-component developer including nonmagnetic toner and magnetic carrier having a negative charging polarity by agitation conveyance members 42 and 43, and thus charges the toner and carrier by friction as illustrated in FIG. 2. The developer is circulated inside a container 40 by the agitation conveyance members 42 and 43, and born on a developing sleeve 41 serving as a developer bearing member as a result of a magnetic field generated by a magnet disposed on the inner peripheral side of the developing sleeve 41. The thickness of the developer born on the developing sleeve 41 is regulated by a regulating blade, and then the developer is conveyed to a portion opposing the photosensitive drum 2*a*. The developing sleeve 41 is held at a position away from the photosensitive drum by a predetermined distance. By applying an oscillating voltage in which an alternating current voltage is superimposed on a direct current voltage of a negative polarity to the developing sleeve 41, negatively charged toner is transferred onto an exposed portion of the photosensitive drum 2*a* that has come to have a relatively positive polarity, and the electrostatic latent image is developed in an inverted manner. The length of the developing sleeve 41 in the longitudinal direction thereof is set such that, for example, an electrostatic latent image having a maximum length of 30 cm can be developed.

As the developer, a two-component developer in which a carrier and a toner are mixed in a weight ratio of 94:6 is used. The initial value of the total weight of the developer accommodated in the developing unit 4*a* is set to 250 g. Ferrite particles coated with a silicone resin are used as the carrier, and the carrier has a saturation magnetization of 24 $Am^2/kg$ with respect to an applied magnetic field of 240 kA/m. In addition, the carrier has a volume resistivity of $1\times10^7$ Ω·cm to $1\times10^8$ Ω·cm with respect to a field intensity of 3000 V/cm, and has a weight average particle diameter of 50 μm. The toner is constituted by at least a binder, a colorant, and a charge control agent. Here, a styrene acrylic resin is used as the binder resin. However, other resins such as a styrene-based resin, a polyester-based resin, and a polyethylene resin can be also used. As the colorant, colorants such as various pigments and dyes may be used alone or in combination of two or more kinds. As the charge control agent, a charging control agent for reinforcement may be contained if necessary. As the charging control agent for reinforcement, a nigrosine-based dye, a triphenylmethane-based resin, or the like can be used. The weight average particle diameter of the toner or the volume average particle diameter of the toner is 5.5 μm.

The toner contains a wax and an external additive. The wax is contained for improving the releasability from the fixing member and the fixability at the time of fixing. As the wax, paraffine wax, carnauba wax, polyolefin, or the like can be used, and the wax is used by being kneaded and dispersed in the binder resin. Here, a resin in which a binder, a colorant, a charge control agent, and a wax are kneaded and dispersed is grinded by a mechanical grinder and is thus used. Examples of the external additive include amorphous silica subjected to hydrophobization and inorganic oxide fine particles of titanium oxide, titanium compounds, and the like. These fine particles are added to the toner to adjust the powder fluidity and amount of charge of the toner and the surface polishing effect of the photosensitive drum 2*a*. The particle diameter of the external additive particles is preferably 1 nm to 100 nm. Here, titanium oxide of an average particle diameter of 50 nm is added in an amount of 0.5 wt % in terms of weight ratio, and amorphous silica of an average particle diameter of 2 nm and amorphous silica of an average particle diameter of 100 nm are respectively added in amounts of 0.5 wt % and 1.0 wt %.

The primary transfer roller 9*a* forms a primary transfer portion T1 between the photosensitive drum 2*a* and the intermediate transfer belt 8. By applying a direct current voltage of a positive polarity to the primary transfer roller 9*a*, the toner image born on the photosensitive drum 2*a* is transferred onto the intermediate transfer belt 8 through primary transfer.

The intermediate transfer belt 8 is an endless belt member. As the intermediate transfer belt 8, a belt formed from polyether ether ketone having a volume resistivity ρv of $10^{10}$ Ω·cm and a surface resistivity ρs of $10^{8}$Ω is used. To be noted, the volume resistivity ρv of the intermediate transfer belt 8 is preferably $10^{8}$ Ω·cm to $10^{12}$ Ω·cm, and the surface resistivity ρs of the intermediate transfer belt is preferably $10^{8}$Ω to $10^{13}$Ω. As the material of the intermediate transfer belt, polyether ether ketone and polyimide are generally used.

The drum cleaning unit 6*a* includes a cleaning blade 60 as illustrated in FIG. 2. The cleaning blade 60 has a distal end portion extending in a direction inclined so as to oppose the rotation direction of the photosensitive drum 2*a*, and the distal end portion abuts the photosensitive drum 2*a* to collect soiling matter such as transfer residual toner remaining on the surface of the photosensitive drum 2*a*. The cleaning blade 60 is formed by, for example, sticking a rubber member constituted by a flat plate of urethane rubber to a metal plate member by a glue. This rubber member is formed to have, for example, a sectional shape of a thickness of 2 mm and a free length of 8 mm, and is stuck to the metal plate member in an area having a length of 33 cm in the longitudinal direction. The free length is a length of a part projecting from the metal plate member. As the rubber member, urethane rubber having a hardness of 77 degrees in terms of JIS-A hardness (i.e., hardness measured with a type-A durometer) and a thickness of 2 mm is used. The hardness is measured by indenting and deforming the surface thereof by an indenter, and measuring the amount of deformation, that is, the indentation depth. In addition, the cleaning blade 60 abuts the surface of the photosensitive drum 2*a* at an abutting angle of 23 degrees with respect to a tangent direction of the surface of the photosensitive drum 2*a* by a pressure of 30 N/m. To be noted, it is preferable that the cleaning blade 60 abuts the surface of the photosensitive drum 2*a* at an abutting angle of 18 to 35 degrees with respect to the surface of the photosensitive drum 2*a* by a pressure of 14.7 N/m to 44.1 N/m.

Charging Roller

Figure 3:
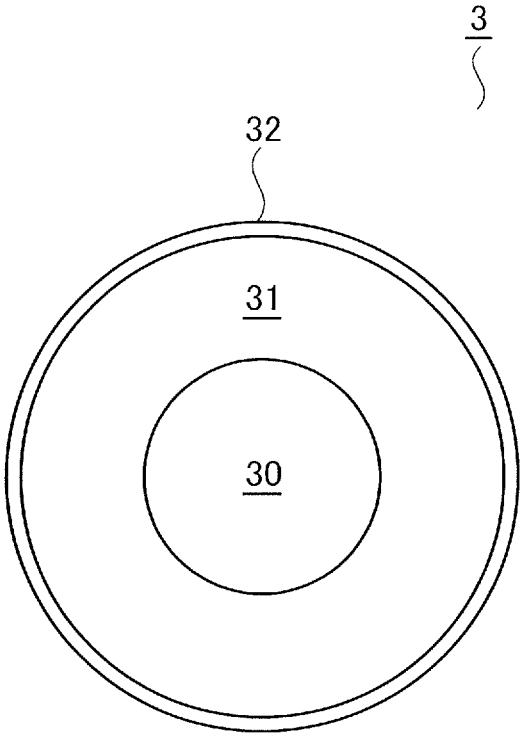
FIG. 3 is a schematic diagram illustrating a sectional configuration of a charging roller.

A configuration of the charging roller according to the present exemplary embodiment will be described with reference to FIG. 3. FIG. 3 is a schematic diagram illustrating a sectional configuration of a charging roller 3 that can be used as the charging rollers 3*a* to 3*d* of the image forming apparatus 100 described above.

The charging roller 3 of the present exemplary embodiment includes a core metal 30 serving as a support body, an elastic layer 31 formed on the outer peripheral side of the core metal 30, and a surface layer 32 formed on the outer peripheral side of the elastic layer 31. For example, the core metal 30 is a round stainless steel bar having a diameter of 6 mm, the charging roller 3 has an outer diameter of 12 mm, and the volume resistivity, hardness in terms of JIS-A hardness, and contact area ratio of the charging roller 3 are respectively set to $10^{7}$ Ω·cm, 65 degrees, and 0.3%. The outer diameter of the charging roller 3 is preferably 10 mm to 14 mm, the volume resistivity of the charging roller 3 is preferably $10^{4}$ Ω·cm to $10^{8}$ Ω·cm, the hardness of the charging roller 3 is preferably 50 to 80 degrees, and the contact area ratio of the charging roller 3 is preferably 0.03% to 10%.

Figure 4:
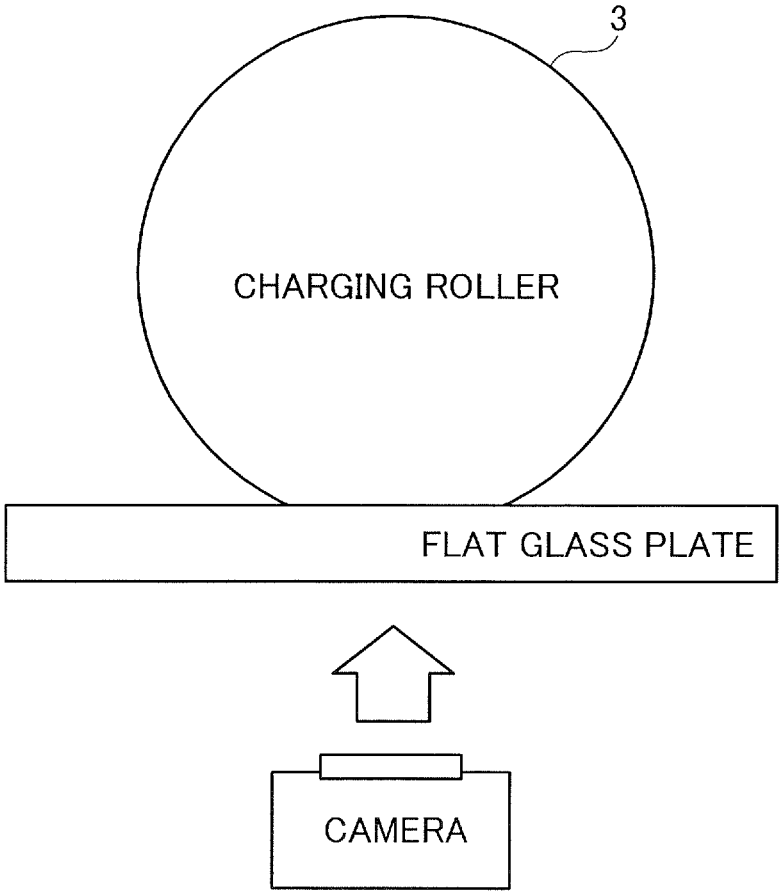
FIG. 4 is a schematic diagram for describing a measurement method for a contact area ratio of the charging roller.

The hardness of the charging roller 3 is a value obtained by indenting and deforming the surface thereof by an indenter and measuring the amount of deformation, that is, the indentation depth. The contact area ratio is obtained by capturing an image of a contact surface on which the charging roller 3 is brought into contact with a flat glass plate by a load of 1 N as illustrated in FIG. 4 by a camera disposed opposite to the charging roller 3 with the flat glass plate therebetween. The value of this load is set such that the area of a contact range between the charging roller 3 and the flat glass plate is approximately equal to the area of a contact range between the charging roller 3 and the photosensitive drum in a state of being installed in an image forming apparatus. The contact range is a rectangular region including all actual contact points. In the captured image, parts where the flat glass plate and the charging roller 3 are in contact appear as black dots having high light absorbance. Therefore, the ratio of black dots per unit area is calculated. For example, a region where the brightness is equal to or below a threshold value in the image data is regarded as a black dot.

The charging roller 3 is held in a rotatable state at both end portions of the core metal 30 respectively by bearing members, and is urged toward the photosensitive drum by a pressing spring. As a result of this, the charging roller 3 is pressed against the surface of the photosensitive drum by a predetermined pressing force.

Surface Roughness of Charging Roller

Here, a relationship between the surface roughness of the charging roller 3, the image quality of an image formed by an electrophotographic process, and the lifetime of the charging roller 3 will be described. Conventionally, imparting an appropriate surface roughness to a charging roller to suppress attachment of toner to the charging roller and improve the durability of the charging roller is known. As an index for the surface roughness, ten point height of roughness profile Rz defined in JIS B0601 (1994) corresponding to ten point height of roughness profile Rzjis defined in Appendix JA of JIS B0601 (2013) is widely used.

The diameter of toner used in an electrophotography apparatus is typically 10 μm or smaller, and toners having an average particle diameter of 4 μm to 8 μm are often employed. Therefore, the mechanical contact between toner particles attached to the photosensitive drum and the surface of the charging roller 3 can be reduced by, for example, setting the ten point height of roughness profile Rz of the surface of the charging roller to a value close to or larger than the average particle diameter of the toner particles. As a result of this, attachment of soiling matter to the charging roller 3 is suppressed, and therefore occurrence of image defects caused by the filming phenomenon can be suppressed.

As methods for controlling the ten point height of roughness profile Rz of the surface of the charging roller, a method of causing the surface layer 32 to contain particles and a method of processing the surface of the charging roller by mechanical polishing have been proposed. However, as a result of detailed study, it has been found that there is a case where rough texture of the image occurs when a conventional charging roller having a ten point height of roughness profile Rz of a value equal to or larger than a certain value is used.

The rough texture of the image refers to an image defect in which microscopic unevenness of density occurs. The rough texture is observed in a very small area as large as the size of the toner particles in an image region in which a uniform toner image of a certain density is supposed to be formed. Although the rough texture is not visually recognized in the case where the roughness of the texture is low, an observer comes to sense sandy texture, that is, grainy feed, as the roughness increases. In addition, in an extreme case, a dot appears in a halftone image.

Therefore, study has been carried out on a method to resolve the rough texture of the image while suppressing the image defect caused by the filming phenomenon. As a result, it has been found that the gentleness of the surface shape is important in addition to the overall surface roughness of the surface of the charging roller. Specifically, it is effective to control the root mean square slope of roughness profile RΔq related to a roughness profile and defined in JIS B0601 (2013) in addition to the ten point height of roughness profile Rz related to a roughness profile of the surface of the charging roller. The ten point height of roughness profile Rz and the root mean square slope RΔq of the roughness profile are defined as follows.

$$Rz = \frac{1}{5}\sum_{j=1}^{5}(Zp_j + Zv_j)$$

$$R\Delta q = \sqrt{\frac{1}{N}\sum_{j=0}^{N}\left(\frac{dZ_j}{dX_j}\right)^2}$$

To be noted, Zpj is the height of the j-th highest peak in the roughness profile, and Zvj is the depth of the j-th lowest valley in the roughness profile. N is the number of measurement points. (dZj/dXj) is a local slope at the j-th measurement point in the roughness profile, and is defined by the following approximate. To be noted, Zj is the height of the j-th measurement point in the roughness profile, and ΔX is a measurement pitch.

$$\frac{dZ_j}{dX_j} = \frac{(Z_{j+3} - 45Z_{j+2} + 90Z_{j+1}90Z_{j-1} + 45Z_{j-2} - Z_{j-3})}{60\Delta X}$$

Comparative Experiment 1

A method for and results of an investigative experiment carried out to investigate the influence of settings of the ten point height of roughness profile Rz and the root mean square slope RΔq on the image will be described below. The investigative experiment was carried out by incorporating charging rollers manufactured in respective setting conditions in copiers manufactured by Canon Inc. The product name of the copiers was image RUNNER ADVANCE 3330.

The setting conditions of the charging rollers used for the experiment were as follows.

Embodiment Condition 1-1: Rz=7 (μm), RΔq=0.10

Embodiment Condition 1-2: Rz=7 (μm), RΔq=0.05

Embodiment Condition 1-3: Rz=13 (μm), RΔq=0.10

Comparative Condition 1-1: Rz=7 (μm), RΔq=0.20

Comparative Condition 1-2: Rz=5 (μm), RΔq=0.10

Comparative Condition 1-3: Rz=13 (μm), RΔq=0.30

The values of the parameters described above were measured by using a surface roughness tester SE-3300H manufactured by Kosaka Laboratory Ltd. The measurement conditions were set to a cutoff of 0.8 mm, a measurement distance of 8 mm, a feed rate of 0.5 mm/sec, and a measurement pitch of ΔX=0.5 μm. In addition, to reduce deviation depending on the measurement position, average values of results of measurement at a total of 12 points made up of 3 points in the axial direction of the charging roller×4 points in the circumferential direction are shown. The 4 points in the circumferential direction were set with intervals of 90 degrees therebetween starting from an arbitrary position.

Items of image evaluation were presence/absence of contamination streaks in an output halftone image and the degree of rough texture of the halftone image, and these were evaluated by visual observation. A contamination streak refers to a state in which a part of high image density is generated along a conveyance direction of a recording material, that is, along the rotation direction of the charging roller. The contamination streak appears at a position corresponding to a position where foreign matter is attached in the case where filming occurs on the charging roller. To investigate how long it takes until filming occurs, an operation of outputting one halftone image of a print coverage of 30% after outputting an image of a print coverage of 3.7% on a predetermined number of sheets in an environment of a room temperature of 23° C. and a humidity of 50% was repeated. Then, the total number of printed sheets of the image of the print coverage of 3.7% output until a visually recognizable contamination streak is generated was recorded.

In addition, for evaluation of rough of texture, one halftone image of a print coverage of 30% output in an initial state was used. As a result of observation, a case where no rough texture was visually recognizable at all was evaluated as "A", a case where no rough texture was visually recognizable but was recognizable when enlarged was evaluated as "B", a case where rough texture was visually recognizable with the naked eye was evaluated as "C", and a case where grainy feel was prominent was evaluated as "D". The results of evaluation performed in respective conditions are shown in Table 1.

TABLE 1

| Item | Ten point height of roughness profile Rz (μm) | Root mean square slope RΔq | Number of sheets output until contamination streak occurred (×1000) | Roughness of texture |
|---|---|---|---|---|
| Embodiment Condition 1-1 | 7 | 0.10 | 200 | B |
| Embodiment Condition 1-2 | 7 | 0.05 | 200 | A |
| Embodiment Condition 1-3 | 13 | 0.10 | 400 | B |
| Comparative Condition 1-1 | 7 | 0.20 | 200 | C |
| Comparative | 5 | 0.10 | 50 | B |

TABLE 1-continued

| Item | Ten point height of roughness profile Rz (μm) | Root mean square slope RΔq | Number of sheets output until contamination streak occurred (×1000) | Roughness of texture |
|---|---|---|---|---|
| Condition 1-2 Comparative Condition 1-3 | 13 | 0.30 | 400 | D |

As shown in Table 1, in Embodiment Condition 1-1, a contamination streak occurred after outputting the image on 200 thousand sheets, and the evaluation of rough texture was "B". In Embodiment Condition 1-2, a contamination streak occurred after outputting the image on 200 thousand sheets, and the evaluation of rough texture was "A". In Embodiment Condition 1-3, a contamination streak occurred after outputting the image on 400 thousand sheets, and the evaluation of rough texture was "B". The evaluation of rough texture was "A" or "B" in all of these conditions in which the root mean square slope RΔq was 0.10 or less.

In contrast, in Comparative Conditions 1-1 to 1-3 in which the root mean square slope RΔq was larger than 0.10, the evaluation of rough texture was worse than in Embodiment Conditions 1-1 to 1-3. In Comparative Condition 1-1 in which the ten point height of roughness profile Rz was 7 μm, which was a value equal to that of Embodiment Condition 1-1, and the root mean square slope RΔq was larger than in Embodiment Condition 1-1, the number of sheets output until a contamination streak occurred did not change, but the evaluation of rough texture was degraded from "B" to "C". In addition, in Comparative Condition 1-3 in which the ten point height of roughness profile Rz was 13 μm, which was a value equal to that of Embodiment Condition 1-3, and the root mean square slope RΔq was larger than in Embodiment Condition 1-3, the number of sheets output until a contamination streak occurred did not change, but the evaluation of rough texture was degraded from "B" to "D". Images output in Comparative Conditions 1-1 and 1-3 had prominent grainy feel.

Further, in Comparative Condition 1-2 in which RΔq was equal to that of Embodiment Conditions 1-1 and 1-3 and the ten point height of roughness profile Rz was 5 μm, which was a value smaller than that of Embodiment Conditions 1-1 and 1-3, the evaluation of rough texture was maintained at "B", but the number of sheets output until a contamination streak occurred was degraded to 50 thousand.

As described above, it was confirmed that the contamination streak becomes less likely to occur as the ten point height of roughness profile Rz is larger, and the degree of rough texture is lowered, that is, improved, as the root mean square slope RΔq is smaller. The mechanism of how this tendency appears will be discussed below.

Mechanism of Occurrence of Contamination Streak

A mechanism of how the number of sheets output until a contamination streak occurs depends on the ten point height of roughness profile Rz of the charging roller 3 will be described with reference to FIGS. 5A to 5D. Here, the description will be given assuming that the ten point height of roughness profile Rz varies as a result of particles P1 and P2 having different particle diameters being dispersed in a resin material 35 constituting the surface layer 32 of the charging roller 3.

Figure 5A:
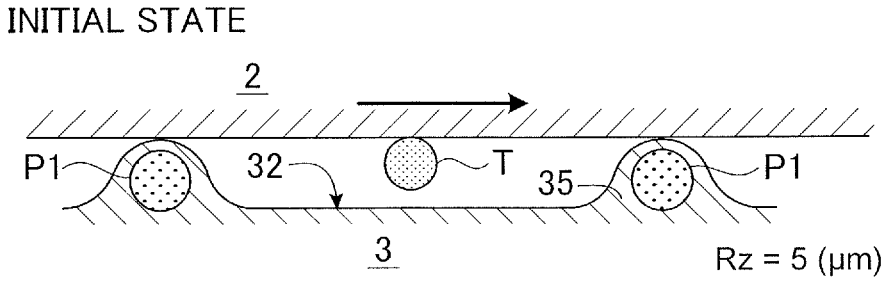
FIG. 5A is a schematic diagrams for describing a process of foreign matter attaching to the surface of the charging roller, corresponding to a case where the surface roughness of the charging roller is low.

FIG. 5A is a schematic diagram illustrating an opposing region between the charging roller 3 and the photosensitive drum 2 in the case where the ten point height of roughness profile Rz in the initial state is set to 5 μm by adding the particles P1 that are relatively small, which corresponds to Comparative Condition 1-2 of Table 1. Since the surface of the charging roller 3 has a recess/projection shape, the contact area ratio of the charging roller 3 in the initial state is suppressed to be small. That is, since the charging roller 3 abuts the photosensitive drum 2 only at the vicinity of apices of projections formed by the particles P1, the frequency of physical contact with soiling matter such as toner particles T attached to the photosensitive drum 2 is low, and thus attachment of the soiling matter to the charging roller 3 is suppressed.

Figure 5B:
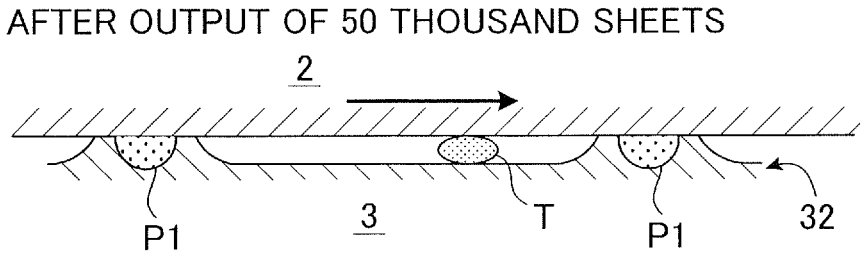
FIG. 5B is another schematic diagrams corresponding to the case where the surface roughness of the charging roller is low.

However, since the projections on the surface of the charging roller 3 wear as the accumulated number of rotations of the photosensitive drum 2 increases, the surface of the charging roller 3 becomes closer to flat as illustrated in FIG. 5B. Then, when the surface roughness becomes equal to or lower than a certain degree, the attachment of soiling matter to the charging roller 3 quickly increases, and contamination streaks start to occur. In the case where the charging roller 3 having a ten point height of roughness profile Rz of 5 μm in the initial state was used in the comparative experiment described above, the ten point height of roughness profile Rz decreased to 4 μm after outputting an image on 50 thousand sheets. In addition, the average particle diameter of toner of the copier used for the experiment was 5.5 μm. Therefore, it is considered that, when the ten point height of roughness profile Rz decreased to be equal to or smaller than the diameter of the toner particles T serving as one kind of main soiling matter, the amount of attachment of toner increased and the contamination streaks occurred.

Figure 5C:
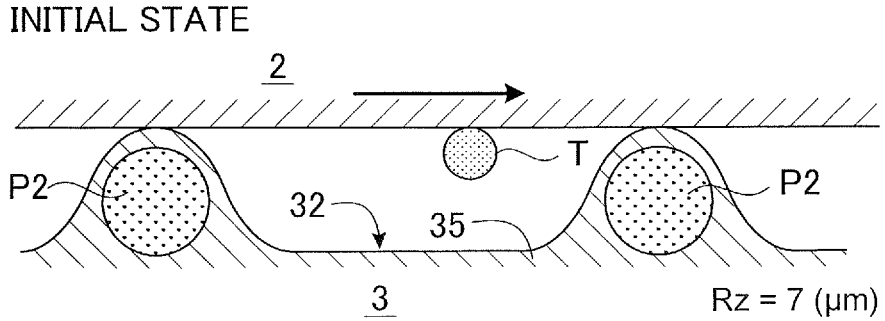
FIG. 5C is a schematic diagrams for describing a process of foreign matter attaching to the surface of the charging roller, corresponding to a case where the surface roughness of the charging roller is high.
Figure 5D:
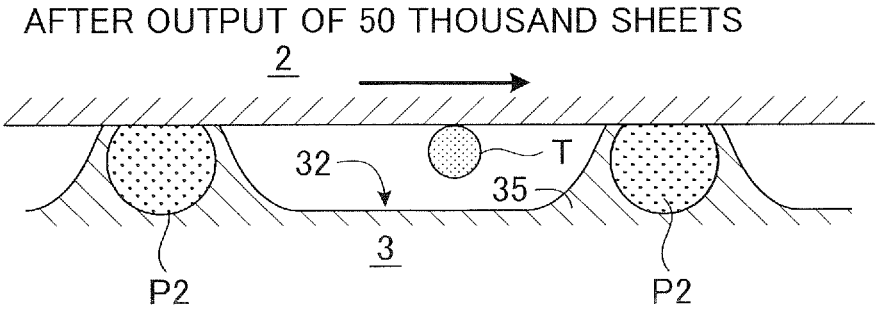
FIG. 5D is another schematic diagrams corresponding to the case where the surface roughness of the charging roller is high.

In contrast, FIG. 5C is a schematic diagram illustrating a case where the ten point height of roughness profile Rz in the initial state was set to 7 μm by adding the particles P2 that are relatively large, which corresponds to Embodiment Conditions 1-1 and 1-2 and Comparative Condition 1-1. The contact area ratio of the charging roller 3 in the initial state is suppressed to be small similarly to the case of FIG. 5A, and thus attachment of soiling matter to the charging roller 3 is suppressed. However, since the ten point height of roughness profile Rz in the initial state is sufficiently large, sufficiently high surface roughness is secured even after outputting an image on 50 thousand sheets. That is, it is considered that the attachment of soiling matter to the charging roller 3 was suppressed even after the output of an image on 50 thousand sheets because the ten point height of roughness profile Rz was larger than 4 μm.

When the ten point height of roughness profile Rz in the initial state is even larger as in Embodiment Condition 1-3 and Comparative Condition 1-3 of Table 1, surface roughness high enough to suppress attachment of soiling matter is secured even after an image is output on a larger number of sheets. That is, it can be seen that the higher the ten point height of roughness profile Rz in the initial state is, attachment of soiling matter to the charging roller 3 is suppressed for a longer period, and occurrence of a contamination streak is suppressed more.

Mechanism of Occurrence of Rough Texture

Next, dependence of the degree of rough texture of an image on the root mean square slope RΔq of the charging roller 3 will be described with reference to FIGS. 6A to 6F. In FIGS. 6A to 6F, FIGS. 6A to 6C illustrate a case where the root mean square slope of the charging roller is relatively large in which RΔq is 0.20, and FIGS. 6D to 6F illustrate a case where the root mean square slope of the charging roller is relatively small in which RΔq is 0.10. To be noted, it is assumed that the ten point height of roughness profile Rz is the same in the case of FIG. 6A and the case of FIG. 6D. In addition, FIGS. 6B and 6E are illustrated such that a higher position in the vertical axis direction indicates a higher potential of a negative polarity.

Figure 6A:
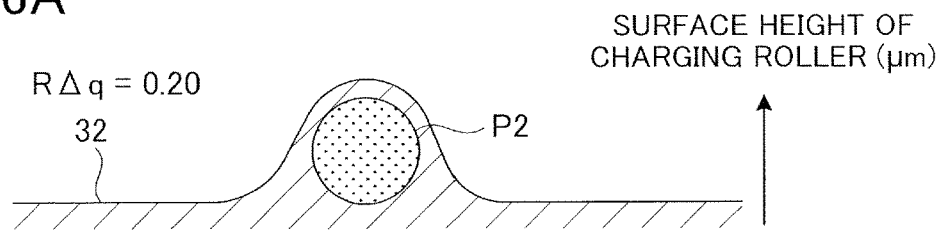
FIG. 6A is a schematic diagrams for describing an influence of the root mean square slope of the charging roller on the density of a toner image formed on a photosensitive drum, corresponding to a case where the root mean square slope is large.
Figure 6B:
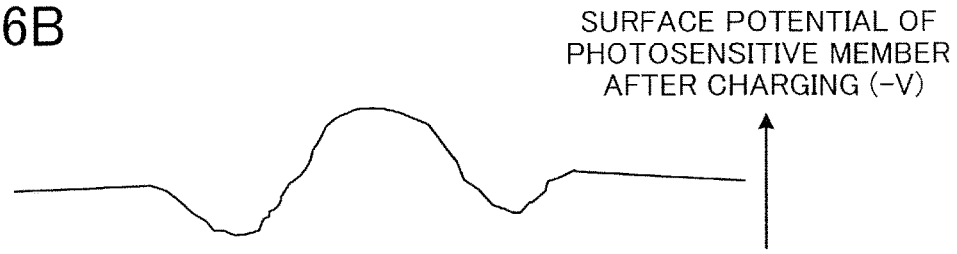
FIG. 6B is another schematic diagrams corresponding to the case where the root mean square slope is large.

In the case where the surface of the charging roller 3 has fine recesses and projections as illustrated in FIG. 6A, the surface potential of the photosensitive drum 2 after charging becomes uneven. This is because, when a charging voltage is applied, a strong electric field is formed in the vicinity of apices of the projections on the surface, the intensity of electric field therearound becomes relatively weak, and thus there is a difference in the amount of electrical discharge. Here, a larger root mean square slope RΔq indicates that the surface of the charging roller has steeper slopes and thus has sharper projections. Therefore, when the value of the root mean square slope RΔq is larger, the unevenness of the field intensity becomes higher, and the surface potential after charging becomes more likely to be uneven.

Figure 6C:
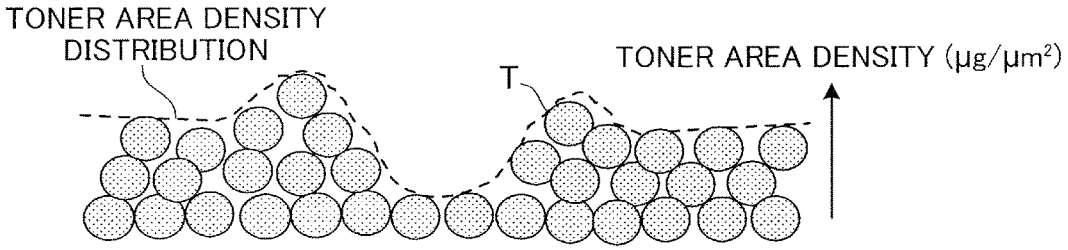
FIG. 6C is another schematic diagrams corresponding to the case where the root mean square slope is large.
Figure 6D:
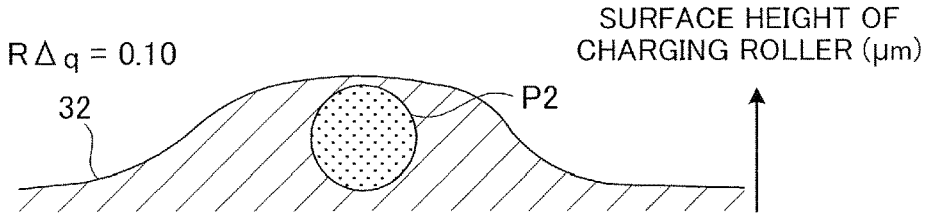
FIG. 6D is a schematic diagram for describing an influence of the root mean square slope of the charging roller on the density of a toner image formed on a photosensitive drum, corresponding to a case where the root mean square slope is small.
Figure 6E:
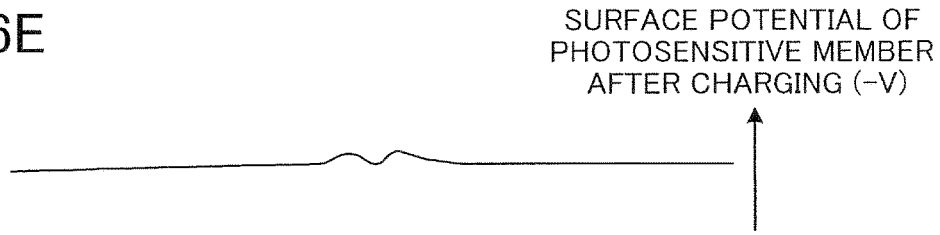
FIG. 6E is another schematic diagrams corresponding to a case where the root mean square slope is small.
Figure 6F:
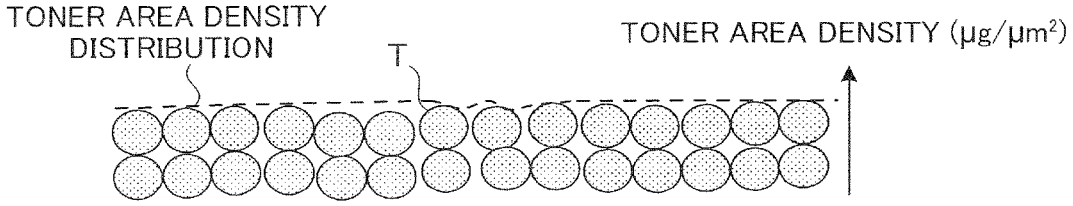
FIG. 6F is another schematic diagrams corresponding to a case where the root mean square slope is small.

When the surface potential of the photosensitive drum 2 after charging is not uniform, the variation in the surface potential remains as potential difference after exposure in the case where exposure of a halftone image that is supposed to have a uniform density is performed. In a developing step, the toner particles T are transferred onto the surface of the photosensitive drum 2 in accordance with the surface potential of the photosensitive drum 2. Therefore, as illustrated in FIG. 6C, in a minute area similar to the area of a projection of the charging roller 3, a toner area density distribution, which is a distribution of number of toner particles per unit area, becomes uneven. Here, the number of toner particles present in 1 $\mu m^2$ is defined as the toner area density distribution. As described above, as a result of an electrophotographic process being performed in a state in which the amount of electrical discharge varies depending on the unevenness of the surface of the charging roller 3, fine unevenness of density occurs in an output image, which causes rough texture of an image.

In contrast, in the case where the root mean square slope RΔq is small even if fine recesses and projections are present on the surface of the charging roller 3 as illustrated in FIG. 6D, the variation in the surface potential after charging is suppressed as illustrated in FIG. 6E. This is because, as a result of the shape of the surface changing more gently than in FIG. 6A, the uniformity of the electric field formed by the application of the charging voltage increases, and the variation in the amount of electrical discharge is suppressed. Further, the potential distribution after exposure and the amount of attachment of toner in the developing step also become closer to uniform, and therefore the toner area density distribution after development becomes uniform as illustrated in FIG. 6F. As a result of this, fine unevenness of density in an output image is suppressed, and the roughness of texture of the image is reduced.

As described above, in the present exemplary embodiment, it has been found that it is important that the ten point height of roughness profile Rz (μm) and the root mean square slope of RΔq that are related to the roughness profile of the surface of the charging roller 3 satisfy Rz≥7 and RΔq≤0.1. As a result of satisfying Rz≥7, a charging roller in which attachment of soiling matter is suppressed for a long period and a contamination streak is not likely to occur can be provided. At the same time, as a result of satisfying RΔq≤0.1, a charging roller in which the variation in the surface potential of the image bearing member after charging is suppressed and which can reduce the roughness of texture of the image while maintaining a function of suppressing attachment of soiling matter can be provided.

To be noted, in Table 1 shown above, the charging roller 3 of Embodiment Condition 1-2 in which the root mean square slope RΔq is set to a smaller value of 0.05, the roughness of texture of the image is further improved as compared with Embodiment Conditions 1-1 and 1-3. That is, it is more preferable that the root mean square slope RΔq satisfies RΔq≤0.05.

In addition, in the case where the toner particle diameter of developer used with the charging roller is known, it is preferable that the ten point height of roughness profile Rz is set to a value larger than the average particle diameter of the toner. As a result of this, at least in the initial state, frequency of physical contact between the surface of the charging roller and the toner particles attached to the image bearing member can be effectively lowered.

Manufacturing Method

Here, a manufacturing method for a charging roller by which the ten point height of roughness profile Rz and the root mean square slope RΔq can be controlled simultaneously will be described. As a method for controlling the surface roughness of the charging roller, a method of dispersing the particles P1 and P2 of appropriate sizes in the surface layer 32 of the charging roller 3 as illustrated in FIGS. 5A and 5C is known. However, as found by intensive study by the present inventors, a method of dispersing particles of a single kind having a high sphericity was not always the most appropriate for controlling both of the ten point height of roughness profile Rz and the root mean square slope RΔq.

As more appropriate manufacturing methods, the following and combinations thereof can be considered:

a method of dispersing flat particles having a low sphericity in the surface layer 32 of the charging roller 3;

a method of dispersing particles of a plurality of kinds having different average particle diameters in the surface layer 32 of the charging roller 3;

a method of forming the surface layer 32 having a structure in which the outer periphery of a resin layer in which particles are dispersed is coated with a thin resin layer, and a method of pressing the charging roller 3 against a dye having a recess/projection shape to transfer the recess/projection shape, that is, imprinting.

To be noted, in the case of the method of dispersing particles in the surface layer 32, attachment of toner to the charging roller can be effectively suppressed by securing the amount of projection of the particles. For example, in the case where an image of a section of the surface layer 32 cut as illustrated in FIG. 5A is captured in a direction perpendicular to the section, at least part of the particles project from a height position corresponding to the average film thickness of the surface layer 32 to the outer peripheral side (to an external side) preferably by 4 μm or more and more preferably by 5 μm or more. Here, the average film thickness of the surface layer 32 refers to the average thickness of the resin material 35 ignoring portions of the surface projecting due to the particles, that is, particle portions. The average film thickness can be obtained by, for example, cutting the surface layer 32 at the same measurement positions as ones used for determination of the ten point height of roughness profile Rz and the root mean square slope RΔq in Comparative Experiment 1 and calculating the average value of film thicknesses at the respect positions. In addition, to secure the amount of projection of the particles, it is effective to suppress the average film thickness of the surface layer to 20 μm or less while mixing particles of an average particle diameter of 2 μm to 15 μm.

Charging System

In the exemplary embodiment described above, description was given on the premise that the charging roller 3 is used in an electrophotography apparatus of a direct current charging system. In the direct current charging system, the power source configuration can be simplified as compared with an alternate current charging system in which a charging voltage in which a direct current voltage and an alternate current voltage are superimposed on one another. On the other hand, since the effect of settling the surface potential of the image bearing member that can be obtained according to the alternate current charging system cannot be obtained according to the direct current charging system, the direct current charging system has a characteristic that the variation in the amount of electrical discharge derived from the surface shape of the charging roller is likely to remain as the variation in the surface potential of the image bearing member. Therefore, the configuration of the charging roller of the present exemplary embodiment can be suitably used for an electrophotography apparatus of a direct current charging system. However, since image defects can occur also in an alternate current charging system when the variation in the amount of electrical discharge is large, the charging roller of the present exemplary embodiment can be effectively used for an electrophotography apparatus of an alternate current charging system.

Other Parameters

In addition, although the root mean square slope RΔq is extracted as a parameter highly correlated with the roughness of texture of an image, a configuration in which the variation in the amount of electrical discharge is not likely to occur may be defined by other surface texture parameters. For example, arithmetical mean roughness Ra and root mean square roughness Rq defined in JIS B0601 (2001) were observed to have a certain degree of correlation with the degree of rough texture. In addition, root mean square gradient Sdq, arithmetical mean height Sa, and root mean square height Sq that are related to area roughness and defined in JIS B0681-2/ISO 25178-2 may be used instead of the root mean square slope RΔq related to a roughness profile. By setting these parameters such that the undulation of the surface of the charging roller is sufficiently gentle, the variation in the amount of electrical discharge of the charging roller 3 can be reduced, and the rough texture of an image can be improved.

Second Exemplary Embodiment

Next, a charging roller according to a second exemplary embodiment will be described. In the present exemplary embodiment, similarly to the first exemplary embodiment, an image defect in which the image density becomes low in a partial region of the output image is suppressed by setting the root mean square slope RΔq related to the roughness profile of the surface of the charging roller to be equal to or smaller than a predetermined value. This image defect will be referred to as a ghost image.

Mechanism of Occurrence of Ghost Image

Figure 7:
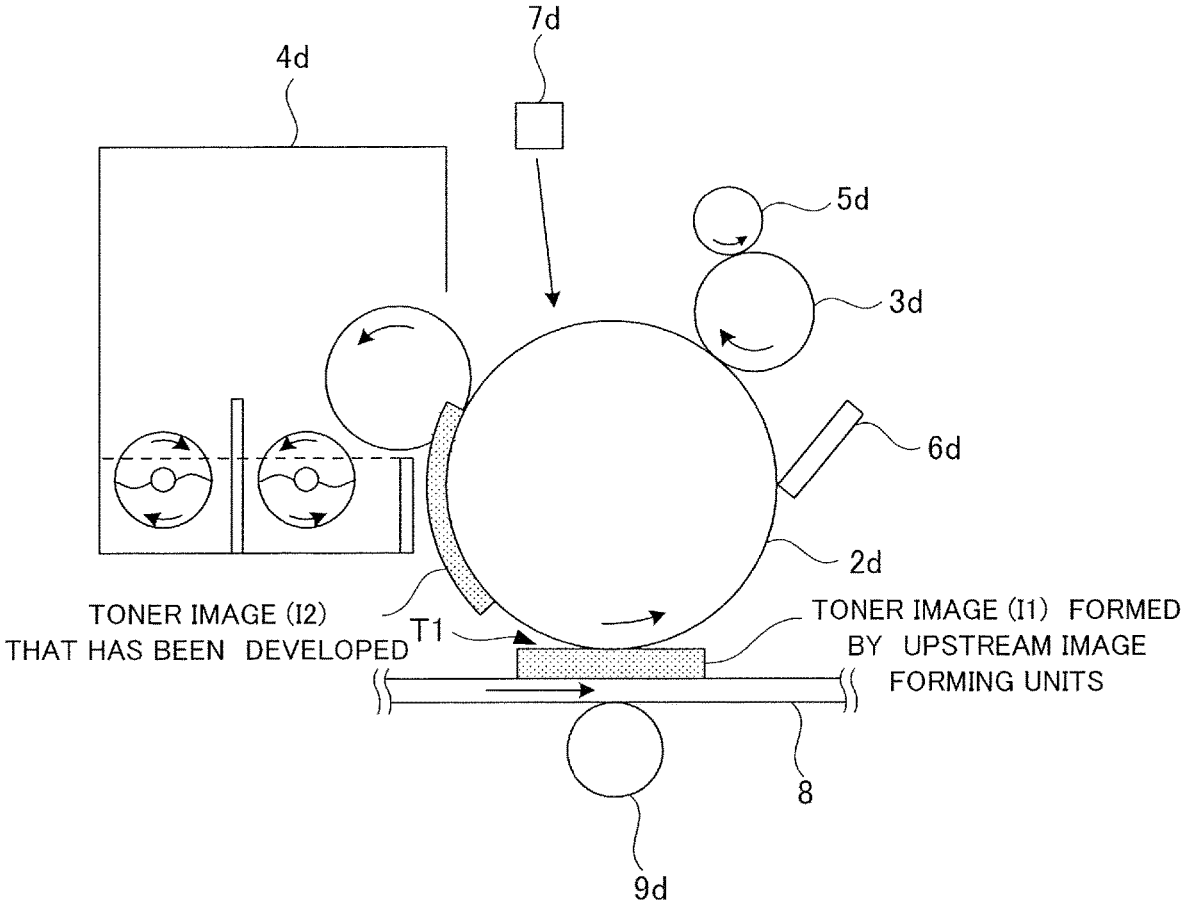
FIG. 7 is a schematic diagram for describing a mechanism of occurrence of a patch ghost.

The mechanism of occurrence of a ghost image will be described with reference to FIG. 7. There is a tendency that a ghost image is likely to occur in an image forming unit on the downstream side in an image forming apparatus of an in-line system, that is, in an image forming apparatus of a tandem type. Therefore, FIG. 7 illustrates an enlarged view of the black image forming unit 1*d* of FIG. 1. In addition, in the following description, elements having the same configuration and effect as in the first exemplary embodiment will be denoted by the same reference signs as in the first exemplary embodiment and description thereof will be omitted.

First, change in the surface potential of the photosensitive drum 2*d* in the primary transfer portion T1 will be described. When an image forming operation is performed, a voltage serving as a primary transfer voltage of a positive polarity, which is a polarity opposite to the charging polarity of the toner, is applied to the primary transfer roller 9*d*. As a result of this, a primary transfer current flows in the primary transfer portion T1 in a direction from the primary transfer roller 9*d* to the photosensitive drum 2*d*, and a bias electric field is formed between the photosensitive drum 2*d* and the intermediate transfer belt 8. The toner image is transferred from the photosensitive drum 2*d* onto the intermediate transfer belt 8 in accordance with this bias electric field, and thus primary transfer of the toner image is performed. In addition, since positive charge is supplied to the surface of the photosensitive drum 2*d* as the primary transfer current, the surface potential of the photosensitive drum 2*d* is shifted to the positive polarity side.

Next, a case where a toner image I1 formed by the image forming units 1*a* to 1*c* present on the upstream side in the rotation direction of the intermediate transfer belt 8 are present in the primary transfer portion T1 is considered. A region where the toner image I1 is present in the primary transfer portion T1, that is, an image portion has higher resistivity than a region where the toner image I1 is not present, that is, a non-image portion, and thus the primary transfer current less easily flows in the image portion. As a result of this, while the surface potential of a region that has not faced the toner image I1 in the primary transfer portion T1 is shifted toward the positive polarity side by the primary transfer current, a region that has faced the toner image I1 remains to have a relatively negative polarity. Then, after charging is performed by the charging roller 3*d*, the region that has faced the toner image I1 is excessively charged to a potential higher than a normal target potential, and thus unevenness occurs in the surface potential of the photosensitive drum 2*d* after charging. This is also called a transfer memory phenomenon. This unevenness of charging is visualized as unevenness of density of a toner image through the exposing step and the developing step, and thus a ghost image is generated. This ghost image appears as image density of a portion that has faced the toner image I1 in the previous transfer step being lower than that of the surroundings thereof in a toner image 12 formed on the photosensitive drum 2*d*.

Here, a relationship between the surface shape of the charging roller 3*d* and likelihood of occurrence of a ghost image will be described. Even in a case where the surface potential of the photosensitive drum 2*d* before charging becomes uneven as a result of the presence of the toner image I1 in the primary transfer portion T1, the surface potential after charging is made uniform if the intensity of the electric field formed around the charging roller 3*d* by the charging voltage is uniform. However, as described in "Mechanism of Occurrence of Rough Texture", the unevenness of surface potential before charging is not sufficiently eliminated in the case where there is a variation in the amount of electrical discharge derived from the recesses and projections on the surface of the charging roller 3*d*. This is because, for example, the surface region of the photosensitive drum 2*d* that has come to have a relatively negative polarity with respect to the surroundings thereof as a result of the presence of the toner image I1 receives more electrical discharge than the surroundings thereof as a result of opposing projections of the charging roller 3*d*, and is thus easily excessively charged.

That is, in the case where macroscopic unevenness of the surface potential derived from the toner image I1 and microscopic unevenness of charging derived from the surface shape of the charging roller 3*d* are superimposed on one another, the unevenness of surface potential of the photosensitive drum 2*d* after charging that causes the ghost image occurs.

To be noted, generally, it is known that the ghost image caused by the transfer memory phenomenon is likely to become noticeable in the case where the difference in the surface potential of the photosensitive drum 2*d* between before and after charging is small. The difference in surface potential between before and after charging is the difference between the surface potential measured at a position immediately before reaching the charging roller 3*d* and the surface potential measured at a position immediately after passing by the charging roller 3*d* in the rotation direction of the photosensitive drum 2*d*. To be noted, each surface potential is measured in a region where an electrostatic latent image is not formed by exposure. The difference in surface potential between before and after charging is affected by, for example, the magnitude of the primary transfer current and the peripheral speed of the photosensitive drum 2*d*, the presence/absence of a pre-exposing unit, and the presence/absence of background exposure. Irradiating also the non-image portion with weak light in the exposing step is referred to as the background exposure.

Comparative Experiment 2

Therefore, to investigate the effect of the root mean square slope RΔq of the charging roller on the ghost image, the following investigative experiment was carried out. The investigative experiment was carried out by incorporating the charging roller in a copier manufactured by Canon Inc. The product name of the copier was image RUNNER ADVANCE 3330.

In the configuration of the present exemplary embodiment, that is, Embodiment Condition 2-1, a charging roller having a root mean square slope RΔq of 0.10 was used as the charging roller 3*d*. The surface resistivity ρs of the intermediate transfer belt was set to $10^8\Omega$, and the primary transfer bias was set such that the primary transfer current was 23 μA. The difference in the surface potential of the photosensitive drum 2*d* between before and after charging was 10V.

In the comparative embodiment, that is, Comparative Conditions 2-1, 2-2, 2-3, and 2-4, a charging roller having a root mean square slope RΔq of 0.20 was used as the charging roller 3*d*.

In Comparative Condition 2-1, the other conditions were the same as Embodiment Condition 2-1.

In Comparative Condition 2-2, a pre-exposing unit was used. In addition, the difference in the surface potential of the photosensitive drum 2*d* between before and after charging was 550 V.

In Comparative Condition 2-3, a belt having a surface resistivity ρs of $10^{12}$, which was higher than that of Embodiment Condition 2-1, was used as the intermediate transfer belt 8. The difference in the surface potential of the photosensitive drum 2*d* between before and after charging was 230 V.

In Comparative Condition 2-4, the value of the primary transfer current was set to 5 μA, which was smaller than that of Comparative Condition 2-3, and the other conditions were the same as in Comparative Condition 2-3.

To be noted, the pre-exposing unit is an electricity removal unit for removing the unevenness of potential of the photosensitive drum 2*d* before charging, and uniformizes the surface potential of the photosensitive drum 2*d* by irradiating the surface of the photosensitive drum 2 with uniform light between the primary transfer portion T1 and the charging roller 3*d*.

In addition, evaluation on the ghost image was determined as follows. A 10 mm×10 mm toner patch whose latent image was formed by the maximum amount of exposure was output in each of the yellow and magenta image forming units 1*a* and 1*b* in an environment of a room temperature of 23° C. and a humidity of 50%. At the same time, a halftone image of a print coverage of 30% is output in the black image forming unit 1*d*. In an output image including the toner patch and the halftone image, a case where a ghost image corresponding to the toner patch, that is, a patch ghost, was visually recognizable was evaluated as "B", and a case where the patch ghost was not visually recognizable was evaluated as "A". Table 2 shows the results of evaluation in respective investigative experiments.

TABLE 2

| Item | Surface resistivity ρs (Ω) of intermediate transfer belt | Primary transfer current (μA) | Pre-exposure | Potential difference between before and after charging (V) | Root mean square slope RΔq of charging roller | Evaluation of patch ghost |
|---|---|---|---|---|---|---|
| Embodiment Condition 2-1 | 10^8 | 23 | No | 10 | 0.10 | A |
| Comparative Condition 2-1 | 10^8 | 23 | No | 10 | 0.20 | B |
| Comparative Condition 2-2 | 10^8 | 23 | Yes | 550 | 0.20 | A |
| Comparative Condition 2-3 | 10^12 | 23 | No | 230 | 0.20 | A |
| Comparative Condition 2-4 | 10^12 | 5 | No | 50 | 0.20 | B |

In the case of Embodiment Condition 2-1 of the present exemplary embodiment, no patch ghost appeared even though the difference in surface potential between before and after charging was as small as 10 V. As a result of comparing the surface potential of the photosensitive drum 2*d* after charging between a position corresponding to the toner patch and a position therearound in Embodiment Condition 2-1, the potential difference was about 1 V. This indicates that the portion of the surface of the photosensitive drum 2*d* which had a potential difference from the surroundings thereof due to the toner patch was charged to a potential almost equal to that of the surroundings thereof when the portion reached the charging roller 3*d* again. As described above, according to the present exemplary embodiment, the potential difference caused by the toner patch is eliminated in the charging step, and thus the occurrence of a ghost image is suppressed.

In contrast, in Comparative Condition 2-1 in which the root mean square slope RΔq was 0.20, a patch ghost occurred. This indicates that the unevenness of field intensity was high as a result of the surface shape of the charging roller 3*d* having steep recesses and projections, and thus the potential difference caused by the toner patch still remained after charging.

In Comparative Condition 2-2 in which the root mean square slope RΔq was equal to that of Comparative Condition 2-1 and in which a pre-exposing unit was provided, no patch ghost appeared. In this condition, the surface potential was made close to the ground potential by the pre-exposing unit, and the charging step was performed in a state in which the potential difference between before and after charging was large. Therefore, it can be seen that the unevenness of the electrical discharge caused by the recesses and projections on the surface of the charging roller 3*d* is not likely to be noticeable in the case where the amount of overall electrical discharge of the charging roller 3*d* is large.

Also in Comparative Condition 2-3 in which an intermediate transfer belt having a high surface resistivity was used, the potential difference between before and after charging was sufficiently large as compared with Embodiment Condition 2-1 of the present exemplary embodiment, and no patch ghost was observed. In contrast, in Comparative Condition 2-4 in which the transfer current was set to a smaller value than in Comparative Condition 2-3, the potential difference between before and after charging became smaller, and thus a patch ghost occurred. As a result of comparing the surface potential of the photosensitive drum 2*d* after charging at a position corresponding to the toner patch and the surroundings thereof, the potential difference was about 15 V. It can be considered that, in this condition, similarly to Comparative Condition 2-1 as a result of the charging step being performed in a condition in which the amount of overall electrical discharge of the charging roller 3*d* is small, the influence of the unevenness of electrical discharge of the charging roller 3*d* became relatively large, and thus the patch ghost became noticeable.

As described above, in the present exemplary embodiment, as a result of setting the root mean square slope RΔq of the surface of the charging roller to 0.10, the patch ghost was successfully suppressed without using a pre-exposing unit. That is, by setting the root mean square slope RΔq to 0.10, a charging roller capable of improving the image quality can be provided. Simultaneously, by setting the ten point height of roughness profile Rz of the charging roller to 7 μm or more, attachment of soiling matter can be suppressed for a long period as described above.

Here, in the case where the difference in the surface potential between before and after charging is small, the amount of electrical discharge of the charging roller 3*d* is reduced as compared with the case where the difference in the surface potential is large, when the output image is the same. Therefore, in the case where the occurrence of ghost image can be suppressed, setting the difference in the surface potential between before and after charging to be small is advantageous from the viewpoint of reducing electrical discharge products that degrades the surface of the photosensitive drum 2*d* and reducing the amount of power consumption. It was found that, according to the present exemplary embodiment, the occurrence of ghost image caused by transfer memory can be suppressed by setting the root mean square slope RΔq to 0.10 or less even in the case where the difference in the surface potential of the image bearing member before and after charging is smaller than 100 V.

To be noted, although description has been given assuming that a pre-exposing unit is not used in the present exemplary embodiment, for example, the charging roller of the present exemplary embodiment may be used together with a pre-exposing unit to more reliably prevent the ghost image.

According to the present invention, the image quality can be improved while suppressing attachment of soiling matter.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-091551, filed on May 10, 2018, which is hereby incorporated by reference herein in its entirety.

What is claimed is:

1. An image forming apparatus comprising:

a photosensitive member; and a charging roller to which a direct current voltage is applied and which is configured to charge a surface of the photosensitive member at a charging position, wherein the charging roller comprises a shaft portion, an elastic layer provided on an outer periphery of the shaft portion, and a surface layer provided on an outer periphery of the elastic layer, wherein a ten point height of roughness profile Rz (μm) and a root mean square slope RΔq with respect to a surface of the charging roller satisfy Rz≥7 and RΔq≤0.1, and wherein a contact area ratio of the charging roller is 0.03% to 10%.

2. The image forming apparatus according to claim 1, wherein the root mean square slope RΔq further satisfies RΔq≤0.05.

3. The image forming apparatus according to claim 1, further comprising a developing unit configured to develop an electrostatic latent image formed on the photosensitive member by applying developer containing toner, wherein the ten point height of roughness profile Rz is larger than a volume average particle diameter of the toner contained in the developer.

4. The image forming apparatus according to claim 1, wherein the surface layer is formed from a resin material in which particles are dispersed, and wherein at least a part of the particles project to an external side by 4 μm or more with respect to an average film thickness of the resin material in a sectional view of the charging roller taken along a plane perpendicular to a rotation axis of the charging roller.

5. The image forming apparatus according to claim 1, wherein the surface layer is formed from a resin material in which particles having particle diameters within a range of 2 μm to 15 μm or less are dispersed.

6. The image forming apparatus according to claim 1, wherein a volume resistivity of the charging roller is $10^4$Ω·cm $10^8$ Ω·cm.

7. The image forming apparatus according to claim 1, wherein a hardness of the charging roller measured with a type-A durometer is 50 degrees to 80 degrees.

8. The image forming apparatus according to claim 1, wherein a difference between a first potential and a second potential of the surface of the photosensitive member in an image forming operation is smaller than 100 V, the first potential being a surface potential of a non-image region of the photosensitive member after the non-image region having been charged by the charging roller has passed through a transfer position at which a toner image formed on the photosensitive member is transferred and before the non-image region passes through the charging position, the second potential being a surface potential of a region of the photosensitive member immediately after the region has passed through the charging position.

9. A cartridge comprising:

a photosensitive member, and a charging roller to which a direct current voltage is applied and which is configured to charge a surface of the photosensitive member at a charging position, wherein the charging roller comprises a shaft portion, an elastic layer provided on an outer periphery of the shaft portion, and a surface layer provided on an outer periphery of the elastic layer, wherein a ten point height of roughness profile Rz (μm) and a root mean square slope RΔq with respect to a surface of the charging roller satisfy Rz≥7 and RΔq≤0.1, and wherein a contact area ratio of the charging roller is 0.03% to 10%.

* * * * *